US006422028B1

(12) United States Patent
Kim

(10) Patent No.: US 6,422,028 B1
(45) Date of Patent: Jul. 23, 2002

(54) AIR CONDITIONER AND METHOD FOR MANUFACTURING THE SAME

(75) Inventor: Dae-Dong Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/780,430

(22) Filed: Feb. 12, 2001

(30) Foreign Application Priority Data

Nov. 11, 2000 (KR) ..... 2000-67002
Nov. 11, 2000 (KR) ..... 2000-67003

(51) Int. Cl.[7] ..... F25D 21/14
(52) U.S. Cl. ..... 62/285; 62/85; 62/259.1
(58) Field of Search ..... 62/285, 288, 291, 62/85, 259.1, 272, 262, 304

(56) References Cited

U.S. PATENT DOCUMENTS 5,085,057 A * 2/1992 Thompson et al. ..... 62/262
5,437,164 A * 8/1995 Consiglio ..... 62/259.1

FOREIGN PATENT DOCUMENTS

JP 06-002888 1/1994

* cited by examiner

*Primary Examiner*—Chen-Wen Jiang
(74) *Attorney, Agent, or Firm*—Robert E. Bushnell, Esq.

(57) ABSTRACT

Disclosed herein is an air conditioner and method for manufacturing the same. The air conditioner includes a condensate water tray attached to the bottom of an evaporator. A rear evaporator cover is situated between the evaporator and an evaporator fan. An upper evaporator cover is situated over the top of the evaporator. The condensate water tray and the rear and upper evaporator covers are integrated into a single body. The method for manufacturing an air conditioner includes the step of attaching a rear evaporator cover and a condensate water tray to a conditioner body while bending the rear evaporator cover and the condensate water tray at the connecting portion thereof. Thereafter, the channel member of the rear evaporator cover is inserted into the condensate water guide hole of a duct. Subsequently, the evaporator is placed on the upper surface of the condensate water tray. Finally, the top of the evaporator is covered with an upper evaporator cover bent and integrally connected to the upper portion of the rear evaporator cover.

25 Claims, 6 Drawing Sheets

AIR CONDITIONER AND METHOD FOR MANUFACTURING THE SAME

This application makes reference to, incorporates the same herein, and claims all benefits accruing under 35 U.S.C. §119 from my application entitled AIR CONDITIONER AND MANUFACTURING METHOD THEREOF filed with the Korean Industrial Property Office on Nov. 11, 2000 and there duly assigned Ser. No. 2000/67002 and my application entitled AIR CONDITIONER filed with the Korean Industrial Property Office on Nov. 11, 2000 and there duly assigned Ser. No. 2000/67003.

BACKGROUND OF THE INVENTION

1. Field of the Invention

The present invention relates generally to an air conditioner and method for manufacturing the same, and more particularly to an air conditioner and method for manufacturing the same, in which the structures of its condensate water tray, its evaporator cover and its condensate water drainage (which are located around its evaporator) are improved.

2. Description of the Prior Art

As illustrated in FIG. 1, in a general window mount type air conditioner, an indoor air inlet section 2 and an indoor air outlet section 3 are formed on the front of a conditioner body 1 to suck and exhaust indoor air, while an outdoor air inlet section 4 and an outdoor air outlet section (not shown) are formed on the rear of the conditioner body 1 to suck and exhaust outdoor air. An evaporator 5 for cooling the indoor air and an evaporator fan 6 for forcibly sending the indoor air cooled in the evaporator 5 toward the indoor air outlet section 3 are situated in the conditioner body 1 so as to be inwardly spaced apart from the indoor air inlet section 2.

A duct 7 is positioned around the evaporator fan 6, and forms an air passage to guide the indoor air sent by the evaporator fan 6 toward the indoor air outlet section 3. A rear evaporator cover 8 and an upper evaporator cover 9 are mounted behind and over the evaporator 5, respectively, so as to define an evaporator room and an air exhaust passage. An opening 8*a* is formed through the rear evaporator cover 8 to allow indoor air having exchanged heat with the evaporator 5 to flow toward the evaporator fan 6. A condensate water tray 10 is disposed under the evaporator 5 to collect and discharge condensate water formed on the surface of the evaporator 5.

In order to collect condensate water on the center portion of the condensate water tray 10, an edge projection 10*a* is formed on the condensate water tray 10 and the floor of the condensate water tray 10 is inclined toward its center. A discharge cutout 10*b* is formed on the rear center portion of the edge projection 10*a* to discharge the condensate water to the outside.

The condensate water tray 10 is formed of Styrofoam of an insulating material to prevent dew from being formed on the indoor side of a base plate 11. An adhesive sealing member (not shown) is attached to the lower surface of the condensate water tray 10 to prevent condensate water discharged through the discharge cutout 10*b* from infiltrating into the space between the condensate water tray 10 and the base plate 11. The reason for this is to prevent dew from being formed on the exterior surface of the indoor side of the base plate 11 by cold condensate water.

In the assembly of the general air conditioner, the rear evaporator cover 8 is secured to the evaporator 5 by means of screws, the condensate water tray 10 is attached to the base plate 11, the evaporator 5 is placed on the condensate water tray 10, and the upper evaporator cover 9 is secured to the top of the evaporator 5 by means of screws.

For the conventional air conditioner, the condensate water tray 10, the rear evaporator cover 8 and the upper evaporator cover 9 are separately fabricated. Accordingly, the manufacture of those parts is inconvenient and costly, and the assembly of those parts is difficult owing to the connection of the parts using screws.

In addition, in the conventional air conditioner, the condensate water tray 10 is made of Styrofoam. Accordingly, the strength of the condensate water tray 10 is relatively small, so the condensate water tray 10 may be easily damaged during assembly. Additionally, when the condensate water tray 10 has been used for a long time, the adhesive force of the sealing member attached to the lower surface of the base plate 11 is weakened, thereby causing cold condensate water to infiltrate into the space between the condensate water tray 10 and the base plate 11. As a result, there occurs a problem in which dew may be formed on the exterior surface of the indoor side of the base plate 11.

SUMMARY OF THE INVENTION

Accordingly, the present invention has been made keeping in mind the above problems occurring in the prior art, and an object of the present invention is to provide an air conditioner and method for manufacturing the same, in which its condensate water tray and its rear and upper evaporator covers are integrated into a single body, thereby facilitating the manufacture and assembly of the air conditioner and reducing the manufacturing costs of the air conditioner.

Another object of the present invention is to provide an air conditioner and method for manufacturing the same, which is capable of protecting its condensate water tray from damage by increasing its strength and preventing dew from being formed on the exterior surface of the indoor side of the base plate by blocking the infiltration of condensate water into the space between the condensate water tray and the base plate.

In order to accomplish the above object, the present invention provides an air conditioner, comprising a condensate water tray attached to the bottom of an evaporator, a rear evaporator cover situated between the evaporator and an evaporator fan, and an upper evaporator cover situated over the top of the evaporator, wherein the condensate water tray and the rear and upper evaporator covers are integrated into a single body.

The condensate water tray and the rear and upper evaporator covers are fabricated through an injection molding process, and the condensate water tray and the upper evaporator cover are bendably connected to the rear evaporator cover.

The air conditioner further comprises a bending groove, the bending groove having a predetermined depth and being formed on a portion where the condensate water tray is connected to the rear evaporator cover.

The air conditioner further comprises one or more connecting members connecting the upper and rear evaporator covers that are spaced apart from each other, and one or more bending grooves each having a predetermined depth and being formed on the connecting members.

The air conditioner further comprises a holding channel that is formed on the upper end portion of the rear evaporator cover to receive and hold the rear end portion of the upper evaporator cover.

The air conditioner further comprises a duct positioned around an evaporator fan, the duct forming an air passage to guide indoor air and being provided with a condensate water guide hole at its lower portion, wherein the condensate water tray is provided with a channel member rearwardly extending from the discharge cutout thereof, the channel member being inserted into the condensate water guide hole of the duct.

In addition, the present invention provides a method for manufacturing an air conditioner, comprising the steps of attaching a rear evaporator cover and a condensate water tray to a conditioner body while bending the rear evaporator cover and the condensate water tray at the connecting portion thereof, inserting the channel member of the rear evaporator cover into the condensate water guide hole of a duct, placing the evaporator on the upper surface of the condensate water tray, and covering the top of the evaporator with an upper evaporator cover bent and integrally connected to the upper portion of the rear evaporator cover.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
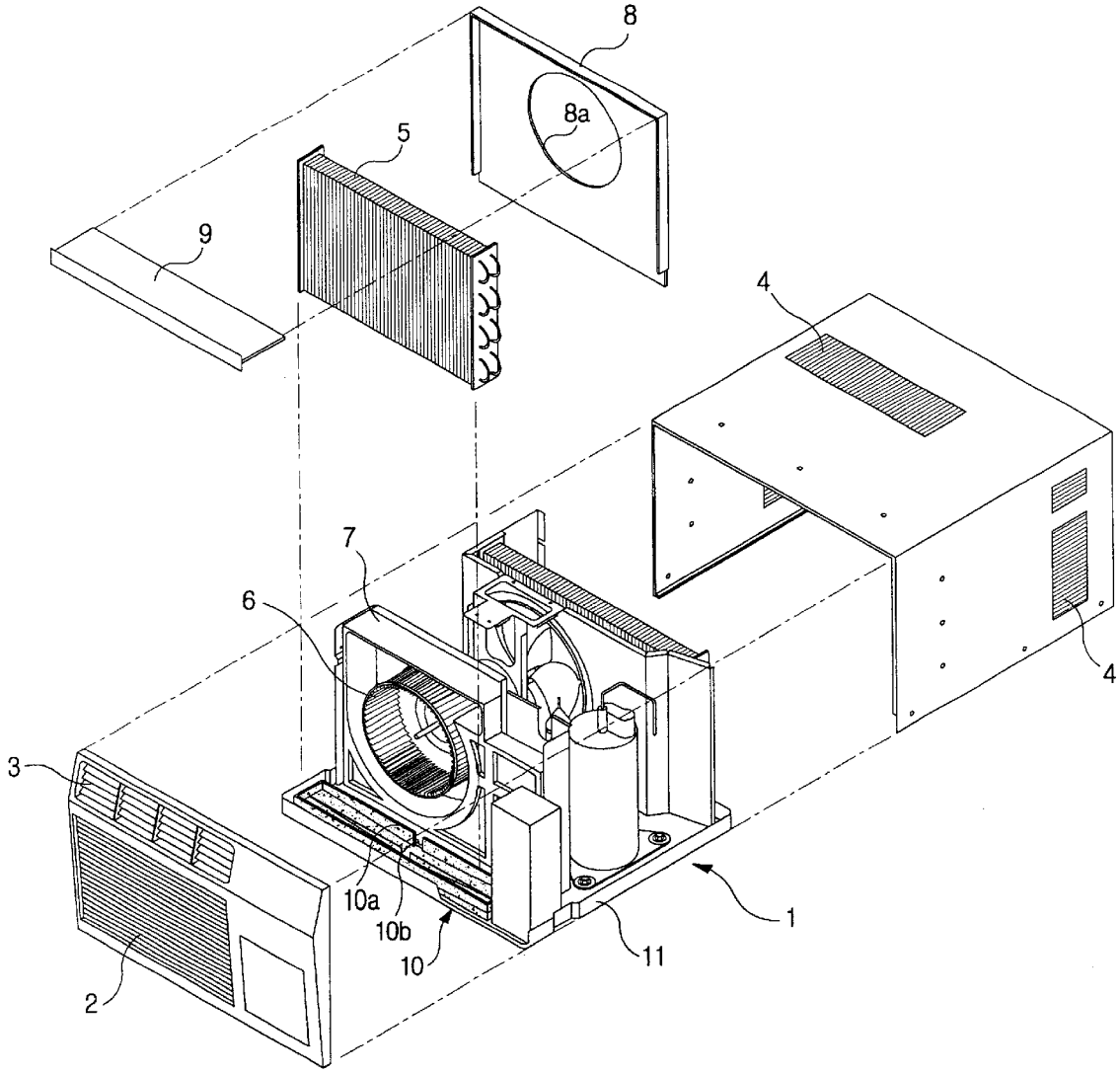
FIG. 1 (PRIOR ART)
FIG. 1 is an exploded perspective view of a conventional air conditioner.

Reference now should be made to the drawings, in which the same reference numerals are used throughout the different drawings to designate the same or similar components.

Figure 2:
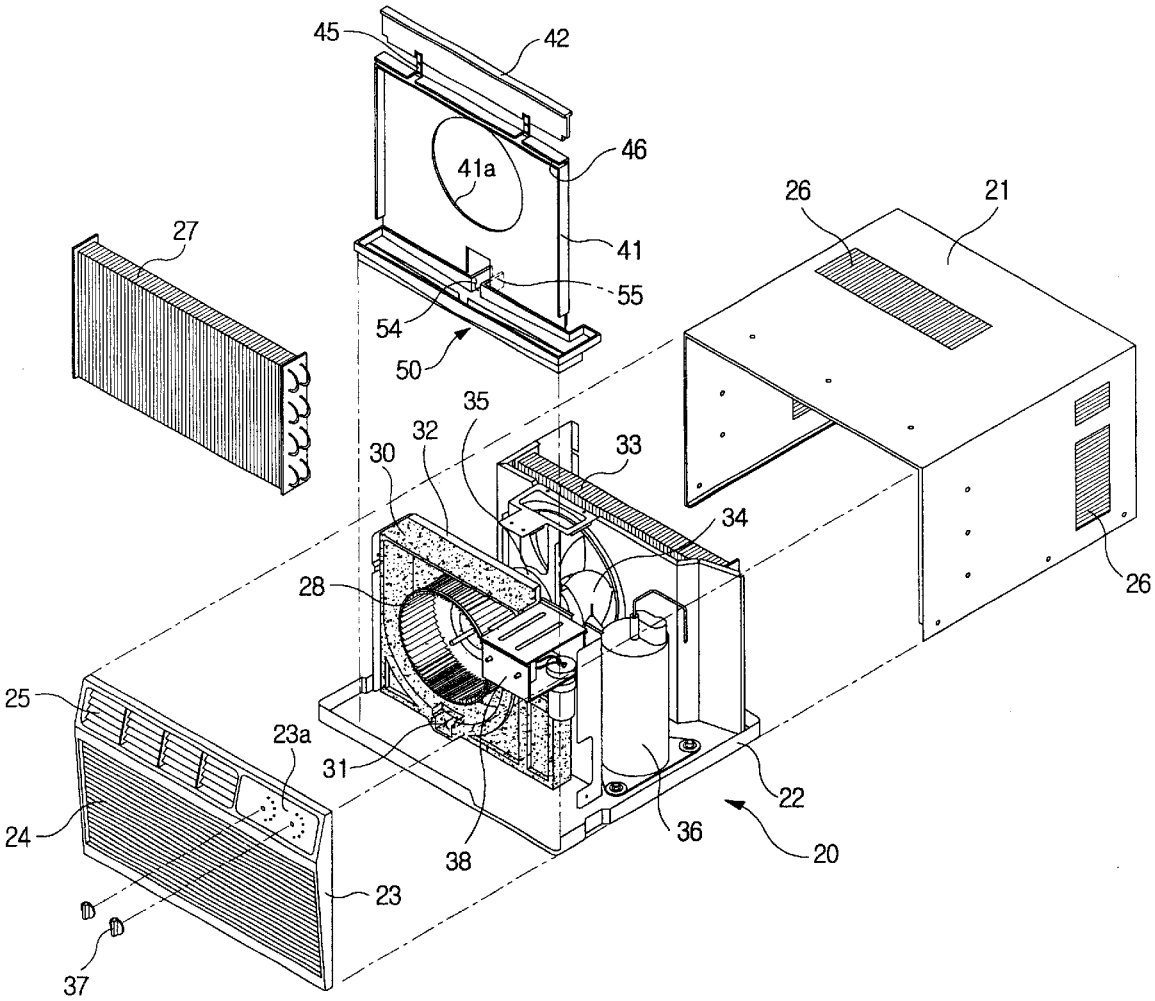
FIG. 2 is an exploded perspective view of an air conditioner of the present invention.

As depicted in FIG. 2, in an air conditioner of the present invention, the exterior of a conditioner body 20 is comprised of an upper case 21, a base plate 22, a front panel 23 and a rear panel (not shown). In such a case, the front panel 23 of the conditioner body 20 is situated inside of a building and the rear panel of the conditioner body 20 is situated outside of the building.

An indoor air inlet section 24 and an indoor air outlet section 25 are formed on the front panel 23 to suck and exhaust indoor air, and outdoor air inlet sections 26 are formed on the top and sides of the upper case 21. Although not shown, an outdoor air outlet section is formed on the rear panel of the conditioner body 20.

An evaporator 27 is situated in the conditioner body 20 so as to be inwardly spaced apart from the indoor air inlet section 24 of the front panel 23, and serves to cool indoor air. An evaporator fan 28 is placed behind the evaporator 27 to suck indoor air. A duct 30 is positioned around the evaporator fan 28 to form an air passage to guide the indoor air sent by the evaporator fan 28 toward the indoor air outlet section 25. A partition 32 is mounted behind the duct 30 to divide the interior space of the conditioner body 20 into an indoor portion and an outdoor portion.

A rear evaporator cover 41 and an upper evaporator cover 42 are respectively mounted behind and over the evaporator 27 so as to define an evaporator room and an air exhaust passage. do A condensate water tray 50 is disposed under the evaporator 27 to collect and discharge condensate water formed on the surface of the evaporator 27.

A condenser 33 and a condenser fan 34 are mounted in the indoor portion of the conditioner body 20. A motor 35 is mounted behind the partition 32 to drive the evaporator fan 28 and the condenser fan 34. A compressor 36 is mounted behind the partition 32 to compress circulated coolant into high-temperature and high-pressure coolant. A control box 38, in which various electric and electronic parts are disposed, is mounted behind the control section 23*a* of the front panel 23 to start, stop and control the air conditioner.

Figure 3:
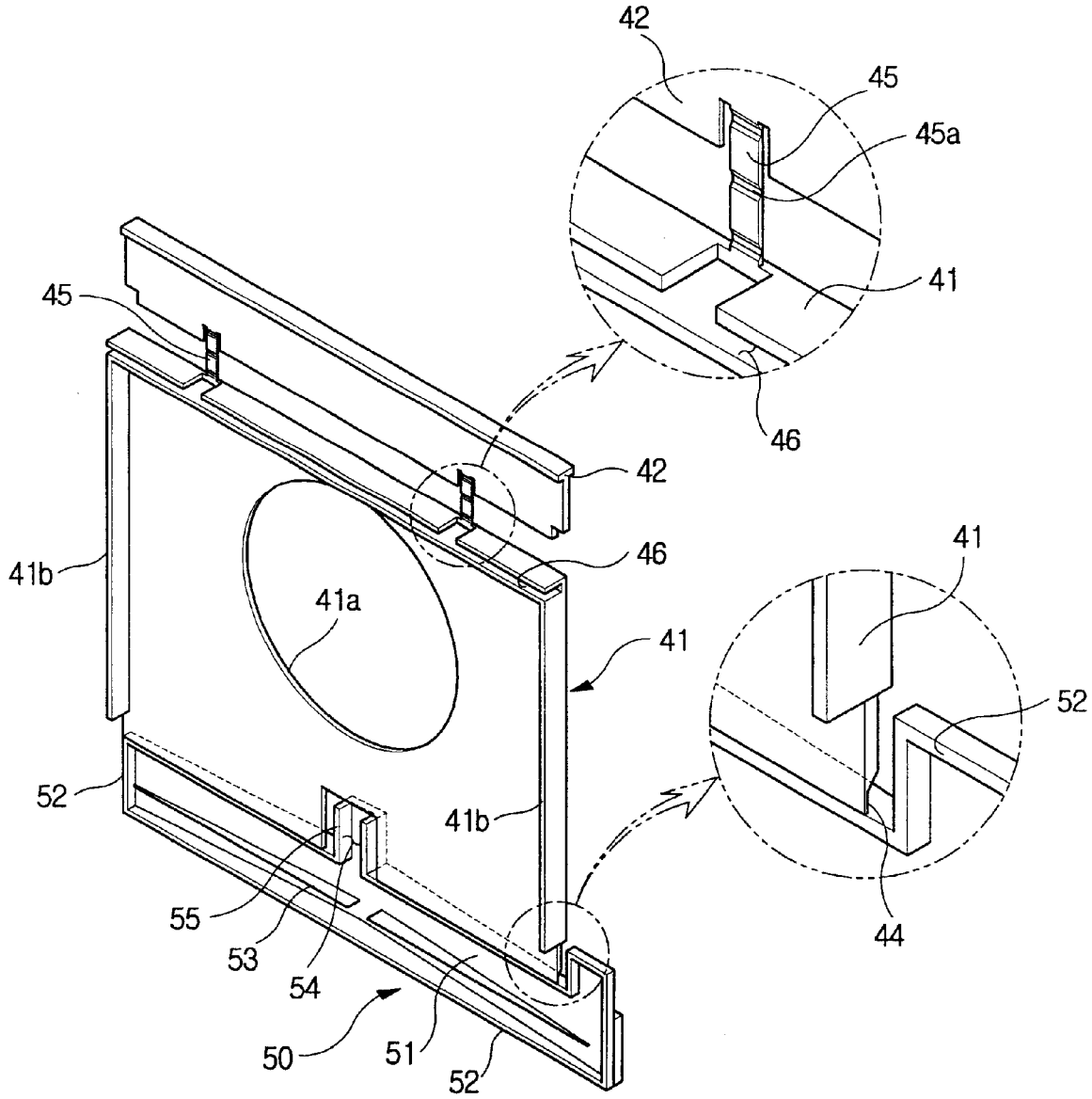
FIG. 3 is a perspective view showing the rear and upper evaporator covers and the condensate water tray of the air conditioner of the present invention.
Figure 4:
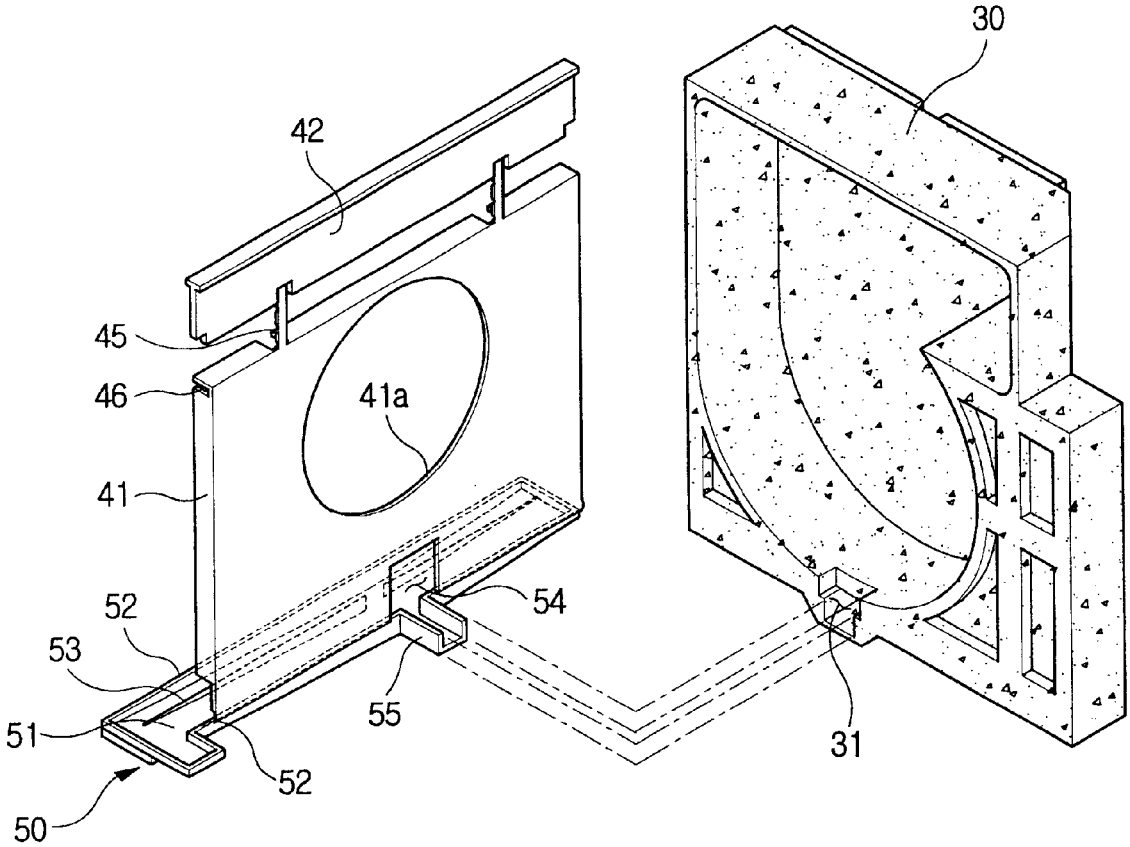
FIG. 4 is a perspective view showing the channel member of the condensate water tray and the condensate water guide hole of a duct in accordance with the present invention.

As illustrated in FIGS. 3 and 4, in order to facilitate the manufacture and assembly of the condensate water tray 50, the rear evaporator cover 41 and the upper evaporator cover 42, the condensate water tray 50, the rear evaporator cover 41 and the upper evaporator cover 42 are integrally fabricated into a single body through a plastic injection molding process.

In such a case, an opening 41*a* is formed through the rear evaporator cover 41 to allow indoor air having exchanged heat with the evaporator 27 to flow toward the evaporator fan 28. Two reinforcing ribs 41*b* are formed on both side edges of the rear evaporator cover 41 to enhance the strength of the cover 41 and support the evaporator 27.

A condensate water tray 50 is disposed under the evaporator 27 to collect and discharge condensate water formed on the surface of the evaporator 27.

In order to collect and discharge condensate water on the center portion of the condensate water tray 50, an edge projection 52 is formed along the edge of the condensate water tray 50, and the floor 51 of the condensate water tray 50 is inclined toward its center. Two evaporator support projections 53 are formed on the condensate water tray 50 to support the evaporator 27 in a state in which the bottom surface of the evaporator 27 is spaced apart from the floor 51 of the condensate water tray 50. A discharge cutout 54 is formed on the rear center portion of the edge projection 52 to discharge the condensate water to the outside. Additionally, the upper end of the rear portion of the edge projection 52 is integrated with the lower end of the evaporator 27. At this time, a bending groove 44 having a predetermined depth is formed between the upper end of the rear portion of the edge projection 52 and the lower end of the evaporator 27, so as to allow the condensate water tray 50 to be bent while the evaporator cover 41 and the condensate water tray 50 are mounted on the base plate 22.

A channel member 55, which extends rearwardly by a predetermined distance, is provided so as to be connected to the discharge cutout 54 and to allow condensate water collected on the condensate water tray 50 to be discharged behind the conditioner body 20. The channel member 55 is integrated with the rear evaporator cover 41 and the condensate water tray 50 into a single body through an injection molding process.

Figure 5:
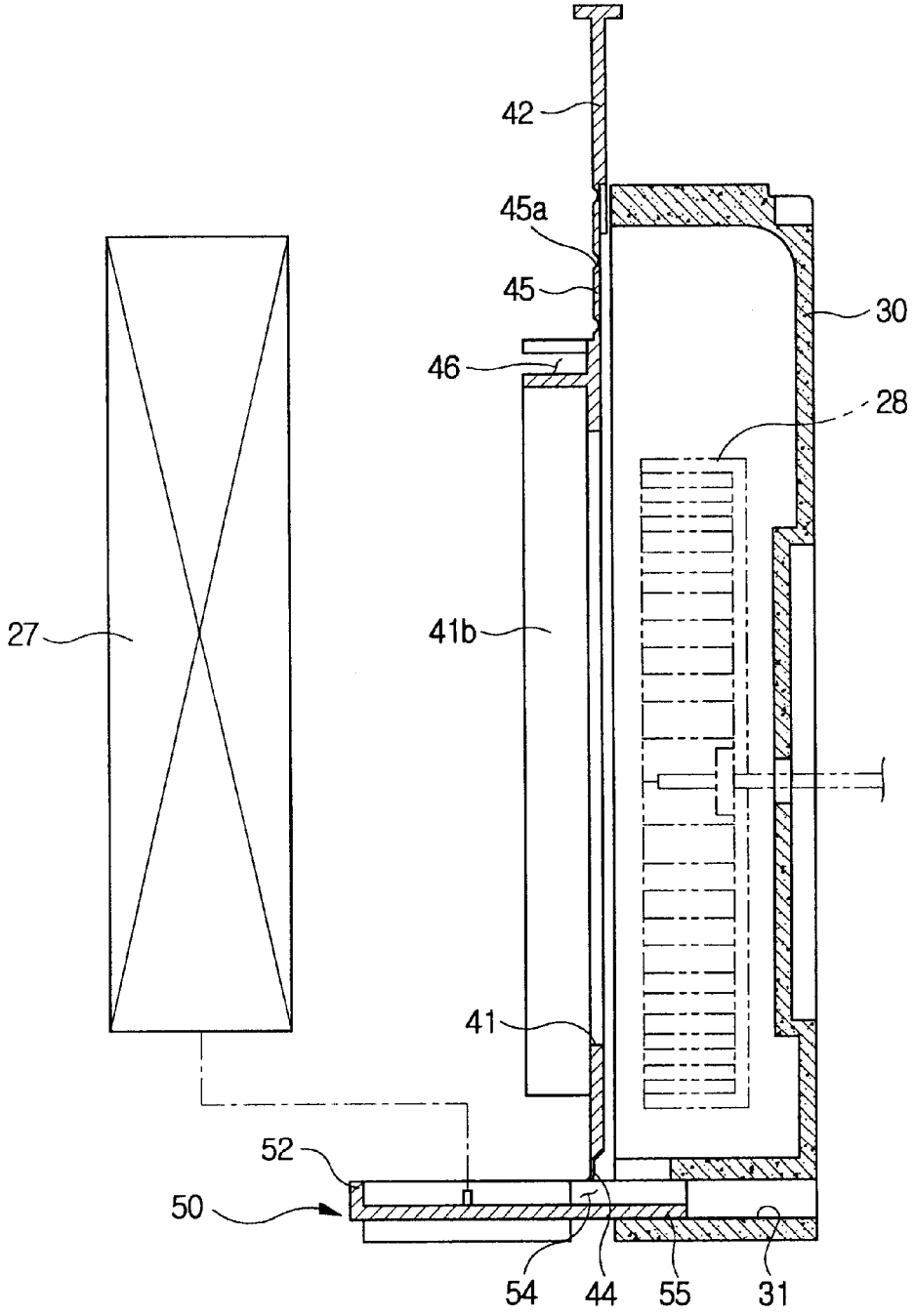
FIGS. 5 and 6 are sectional views showing the assembly of the rear and upper evaporator covers, the condensate water tray and the duct of the air conditioner of the present invention.

As illustrated in FIG. 5, a condensate water guide hole 31 is formed through the lower portion of the duct 30 attached to the rear evaporator cover 41 and the channel member 55 is inserted into the water guide hole 31, thereby allowing condensate water discharged through the channel member 55 to be guided backwardly. The inner width of the water guide hole 31 is designed to coincide with the outer width of the channel member 55.

An upper evaporator cover 42 covering the top of the evaporator 27 is connected to the rear evaporator cover 41 through a bendable connecting member 45 while being spaced apart from the rear evaporator cover 41. In this case, the connecting member 45 is made of the same material as that of the rear and upper evaporator covers 41 and 42, respectively, and is fabricated integrally with the rear and upper evaporator covers 41 and 42, respectively. A plurality of bending grooves 45*a*, each having a predetermined depth, are formed on the upper and lower end portions and center portion of the connecting member 45 so as to allow the upper evaporator cover 42 to be bent after the placement of the evaporator 27. A holding channel 46 is formed on the upper portion of the rear evaporator cover 41 to receive and hold the rear portion of the upper evaporator cover 42.

Figure 6:
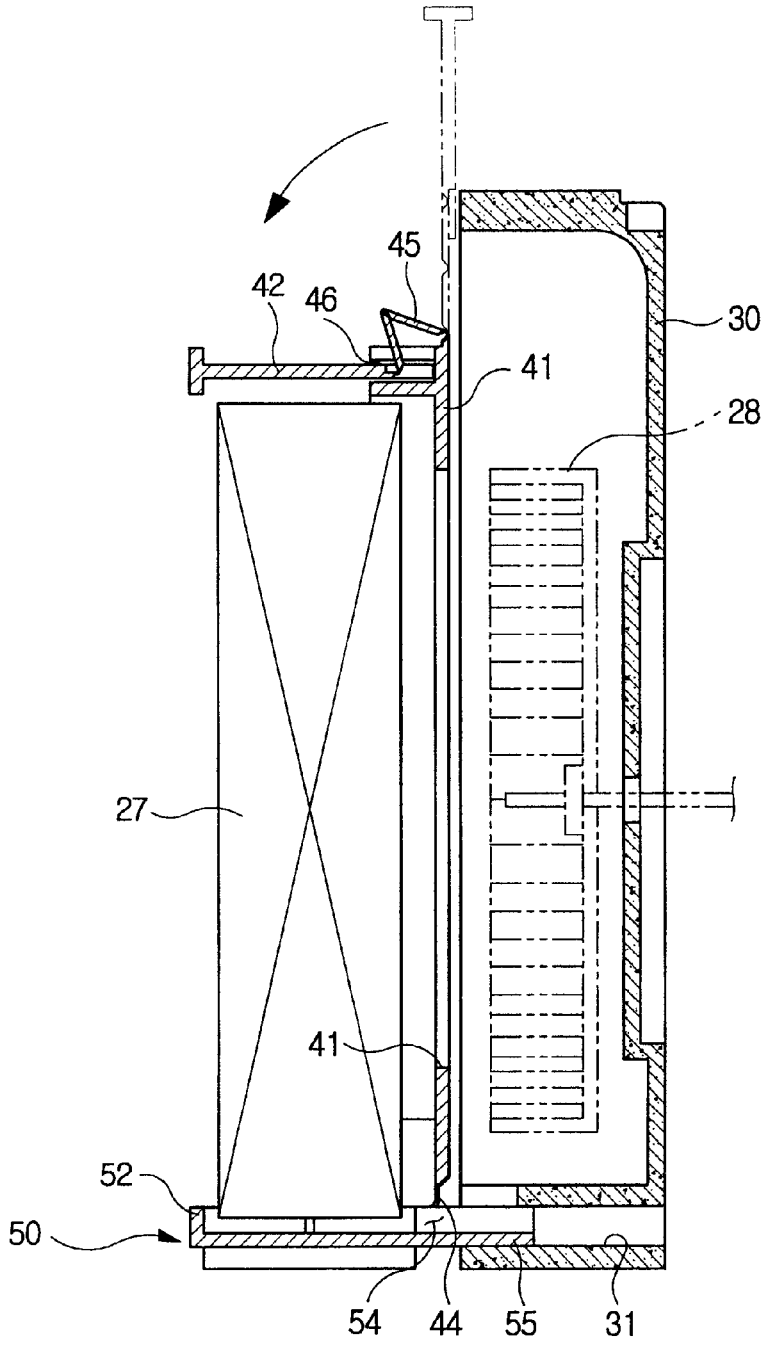

As shown in FIG. 5, in the assembly of the air conditioner of the present invention, the rear evaporator cover 41 and the condensate water tray 50 are attached to the conditioner body 20 while being bent at their connecting portion. When the condensate water tray 50 is bent, the channel member 55 of the condensate water tray 50 projects rearwardly. The condensate water tray 50 and the duct 30 are attached to each other, with the channel member 55 of the condensate water tray 50 inserted into the condensate water guide hole 31. Thereafter, as indicated in FIG. 6, the evaporator 27 is placed on the upper surface of the condensate water tray 50, and the upper evaporator cover 42 is bent to cover the top of the evaporator 27. Additionally, the rear end portion of the upper evaporator cover 42 is inserted into and held by the holding channel 46.

As described above, the present invention provides an air conditioner, in which its condensate water tray and its rear and upper evaporator covers are integrated into a single body through an injection molding process, and are connected to one another by bendable connecting portions, thereby facilitating the manufacture and assembly of the air conditioner and considerably reducing the manufacturing costs of the air conditioner.

In addition, in the air conditioner of the present invention, the condensate water tray is fabricated through an injection molding process, so that the strength of the water tray is considerably increased. Condensate water is guided to the rear of the air conditioner through the channel member of the condensate water tray and the condensate water guide hole of the duct, so that the condensate water does not infiltrate into the indoor side of a base plate, thereby preventing dew from being formed on the outer surface of the indoor side of the base plate.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner, comprising:

a condensate water tray attached to a bottom of an evaporator;

a rear evaporator cover situated between said evaporator and an evaporator fan; and an upper evaporator cover situated over a top of said evaporator;

wherein said condensate water tray and said rear and upper evaporator covers are fabricated through an injection molding process so as to be integrated into a single body.

2. The air conditioner according to claim 1, wherein said condensate water tray and said upper evaporator cover are bendably connected to said rear evaporator cover.

3. The air conditioner according to claim 2, further comprising a bending groove, said bending groove having a predetermined depth and being formed on a portion where said condensate water tray is connected to said rear evaporator cover.

4. The air conditioner according to claim 1, further comprising:

at least one connecting member, said at least one connecting member connecting said upper and rear evaporator covers to each other; and at least one bending groove, said at least one bending groove having a predetermined depth and being formed on said at least one connecting member.

5. The air conditioner according to claim 1, further comprising a holding channel, said holding channel being formed on an upper end portion of said rear evaporator cover to receive and hold a rear end portion of said upper evaporator cover.

6. The air conditioner according to claim 1, further comprising a duct positioned around an evaporator fan, said duct forming an air passage to guide indoor air and being provided with a condensate water guide hole at a lower portion of said duct;

wherein said condensate water tray is provided with a channel member extending rearwardly from a discharge cutout of said rear evaporator cover;

said channel member being inserted into the condensate water guide hole of said duct.

7. A method for manufacturing an air conditioner, comprising the steps of:

attaching a rear evaporator cover and a condensate water tray to an air conditioner body while bending said rear evaporator cover and said condensate water tray at connecting portions thereof;

inserting a channel member of said rear evaporator cover into a condensate water guide hole of a duct;

placing an evaporator on an upper surface of said condensate water tray; and covering a top of said evaporator with an upper evaporator cover bent and integrally connected to an upper portion of said rear evaporator cover.

8. An air conditioner, comprising:

a condensate water tray attached to a bottom of an evaporator;

a rear evaporator cover situated between said evaporator and an evaporator fan; and an upper evaporator cover situated over a top of said evaporator;

wherein said condensate water tray and said upper evaporator cover are bendably connected to said rear evaporator cover.

9. The air conditioner according to claim 8, further comprising a bending groove, said bending groove having a predetermined depth and being formed on a portion where said condensate water tray is connected to said rear evaporator cover.

10. The air conditioner according to claim 8, further comprising:

at least one connecting member, said at least one connecting member connecting said upper and rear evaporator covers to each other; and at least one bending groove, said at least one bending groove having a predetermined depth and being formed on said at least one connecting member.

11. The air conditioner according to claim 8, further comprising a holding channel, said holding channel being formed on an upper end portion of said rear evaporator cover to receive and hold a rear end portion of said upper evaporator cover.

12. The air conditioner according to claim 8, further comprising a duct positioned around an evaporator fan, said duct forming an air passage to guide indoor air and being provided with a condensate water guide hole at a lower portion of said duct;

wherein said condensate water tray is provided with a channel member extending rearwardly from a discharge cutout;

said channel member being inserted into the condensate water guide hole of said duct.

13. An air conditioner, comprising:

a condensate water tray attached to a bottom of an evaporator;

a rear evaporator cover situated between said evaporator and an evaporator fan;

an upper evaporator cover situated over a top of said evaporator; and a bending groove, said bending groove having a predetermined depth and being formed on a portion where said condensate water tray is connected to said rear evaporator cover.

14. The air conditioner according to claim 13, further comprising:

at least one connecting member, said at least one connecting member connecting said upper and rear evaporator covers to each other; and at least one bending groove, said at least one bending groove having a predetermined depth and being formed on said at least one connecting member.

15. The air conditioner according to claim 13, further comprising a holding channel, said holding channel being formed on an upper end portion of said rear evaporator cover to receive and hold a rear end portion of said upper evaporator cover.

16. The air conditioner according to claim 13, further comprising a duct positioned around an evaporator fan, said duct forming an air passage to guide indoor air and being provided with a condensate water guide hole at a lower portion of said duct;

wherein said condensate water tray is provided with a channel member extending rearwardly from a discharge cutout of said rear evaporator cover;

said channel member being inserted into the condensate water guide hole of said duct.

17. An air conditioner, comprising:

a condensate water tray attached to a bottom of an evaporator;

a rear evaporator cover situated between said evaporator and an evaporator fan;

an upper evaporator cover situated over a top of said evaporator; and at least one connecting member, said at least one connecting member connecting said upper and rear evaporator covers to each other; and at least one bending groove, said at least one bending groove having a predetermined depth and being formed on said at least one connecting member.

18. The air conditioner according to claim 17, wherein said condensate water tray and said rear and upper evaporator covers are fabricated through an injection molding process, and said condensate water tray and said upper evaporator cover are bendably connected to said rear evaporator cover.

19. The air conditioner according to claim 17, further comprising a holding channel, said holding channel being formed on an upper end portion of said rear evaporator cover to receive and hold a rear end portion of said upper evaporator cover.

20. The air conditioner according to claim 17, further comprising a duct positioned around an evaporator fan, said duct forming an air passage to guide indoor air and being provided with a condensate water guide hole at a lower portion of said duct;

wherein said condensate water tray is provided with a channel member extending rearwardly from a discharge cutout of said rear evaporator cover;

said channel member being inserted into the condensate water guide hole of said duct.

21. An air conditioner, comprising:

a condensate water tray attached to a bottom of an evaporator;

a rear evaporator cover situated between said evaporator and an evaporator fan;

an upper evaporator cover situated over a top of said evaporator; and a holding channel, said holding channel being formed on an upper end portion of said rear evaporator cover to receive and hold a rear end portion of said upper evaporator cover.

22. The air conditioner according to claim 21, wherein said condensate water tray and said rear and upper evaporator covers are fabricated through an injection molding process, and said condensate water tray and said upper evaporator cover are bendably connected to said rear evaporator cover.

23. The air conditioner according to claim 21, further comprising a duct positioned around an evaporator fan, said duct forming an air passage to guide indoor air and being provided with a condensate water guide hole at a lower portion of said duct;

wherein said condensate water tray is provided with a channel member extending rearwardly from a discharge cutout of said rear evaporator cover;

said channel member being inserted into the condensate water guide hole of said duct.

24. An air conditioner, comprising:

a condensate water tray attached to a bottom of an evaporator;

a rear evaporator cover situated between said evaporator and an evaporator fan;

an upper evaporator cover situated over a top of said evaporator; and a duct positioned around an evaporator fan, said duct forming an air passage to guide indoor air and being provided with a condensate water guide hole at a lower portion of said duct;

wherein said condensate water tray is provided with a channel member extending rearwardly from a discharge cutout of said rear evaporator cover;

said channel member being inserted into the condensate water guide hole of said duct.

25. The air conditioner according to claim 24, wherein said condensate water tray and said rear and upper evaporator covers are fabricated through an injection molding process, and said condensate water tray and said upper evaporator cover are bendably connected to said rear evaporator cover.

* * * * *